US012590768B2

(12) United States Patent
Huang

(10) Patent No.: US 12,590,768 B2
(45) Date of Patent: Mar. 31, 2026

(54) RADIATOR FAN FIXING BUCKLE DEVICE AND ITS ASSEMBLY STRUCTURE

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 120 days.

(21) Appl. No.: 18/815,740

(22) Filed: Aug. 26, 2024

(65) Prior Publication Data

US 2026/0043625 A1 Feb. 12, 2026

(30) Foreign Application Priority Data

Aug. 8, 2024 (TW) ..... 113129698

(51) Int. Cl.
*F28F 9/26* (2006.01)

(52) U.S. Cl.
CPC ..... *F28F 9/262* (2013.01)

(58) Field of Classification Search
CPC ..... F28F 9/262; F28F 9/0075; F28F 2250/08; H10W 40/60; H10W 40/641; Y10T 24/44; F04D 29/601
USPC ..... 24/308, 455; 165/121, 67
See application file for complete search history.

(56) References Cited

U.S. PATENT DOCUMENTS

| | | | | |
|---|---|---|---|---|
| 7,493,940 | B2 * | 2/2009 | Chen | H01L 23/467 165/80.3 |
| 2007/0044282 | A1 * | 3/2007 | Li | H01L 23/4093 257/E23.086 |
| 2008/0170364 | A1 * | 7/2008 | Li | H01L 23/467 361/692 |
| 2014/0209273 | A1 * | 7/2014 | Hsu | F28D 15/0275 165/80.2 |

FOREIGN PATENT DOCUMENTS

| | | | | |
|---|---|---|---|---|
| CN | 2694358 Y | * | 4/2005 | H01L 23/4093 |
| TW | M302264 U | * | 12/2006 | |
| TW | I314260 B | * | 9/2009 | |
| TW | 201028830 A | * | 8/2010 | |

* cited by examiner

*Primary Examiner* — Tho V Duong
(74) *Attorney, Agent, or Firm* — Che-Yang Chen; Law Office of Michael Chen

(57) ABSTRACT

A radiator fan fixing buckle device and a radiator fan fixing buckle device assembly structure are disclosed. The radiator fan fixing buckle device includes a first buckle and a second buckle. Each buckle has a vertical strip, and two horizontal strips connected to two ends of the vertical strip. The first buckle has a latching protrusion in the middle of the vertical strip, and the free ends of the horizontal strips are respectively bent into a buckling portion. The fixed ends of the horizontal strips of the second buckle are respectively bent into a hook portion, and the fee ends of the horizontal strips are respectively bent to form a buckling portion. Thereby, the two buckles can fix two cooling fans on the two sides of a radiator, and the two buckles are buckled together and cannot be separated without external force.

10 Claims, 13 Drawing Sheets

RADIATOR FAN FIXING BUCKLE DEVICE AND ITS ASSEMBLY STRUCTURE

BACKGROUND OF THE INVENTION

1. Field of the Invention

The present invention relates to the field of radiator fan fixing technology, and more particularly to a radiator fan fixing buckle device and its assembly structure.

2. Description of the Related Art

There are two main types of cooling devices currently used for cooling and dissipating heat on processors: air-cooled cooling devices and liquid-cooled cooling devices. For example, as shown in Taiwan Patent Publication TW200741169A, an air-cooled cooling device uses heat pipes to connect a cold plate and a heat sink, and a radiator fan is installed on one side of the heat sink. As shown in Taiwan Patent Publication TW202347085A, the liquid cooling device uses a liquid cooling radiator connected to a cold plate, and a cooling fan is installed on one side of the liquid cooling radiator. When the above cooling fans are installed on the heat sink or liquid cooling radiator, multiple screws are passed through the four screw holes of the radiator fan, and then the screws are screwed into the screw holes of the heat sink or liquid cooling radiator.

The other type uses buckle devices to fix the radiator fan. The buckle devices come in a variety of styles, including leaf spring buckles and steel wire buckles (also called spring buckles). It is known to fix the radiator fan with steel wire buckles, such as shown in Chinese Patent Publication CN101351104A and Patent Publication CN209343284U, to fix the radiator fan on the heat sink through two left and right steel wire buckles. However, when the conventional steel wire buckle is fastened to the heat sink or the liquid cooling radiator, it is not possible to fix the two radiator fans on both sides of the heat sink or the liquid cooling radiator, and the conventional steel wire buckles cannot be used as long as the structure of the heat sink or the liquid cooling radiator is changed. Therefore, how to solve this problem is the subject that the present invention is to actively overcome.

SUMMARY OF THE INVENTION

The main object of the present invention is to provide a radiator fan fixing buckle device and its assembly structure. The structural design of a first buckle and a second buckle formed by bending a metal strip in one piece allows the first buckle and the second buckle to be hooked and locked together, so as to quickly fix two radiator fans on two sides of a radiator.

In order to achieve the above-mentioned object, the present invention can fix two radiator fans on the front and rear sides of a radiator through a structural design in which a first buckle and a second buckle are hooked together and locked with each other. Furthermore, the present invention can prevent the first buckle from being separated from the second buckle through the structure of the second buckle hooking the first buckle and the structural design of the first buckle being locked on the inner side of the second vertical strip, thereby ensuring that the fixing buckle device fixes the two radiator fans on the front and rear sides of the radiator. The first buckle and the second buckle of the present invention are not buckled on the radiator, so the structural change of the radiator will not affect the functions of the first buckle and the second buckle.

DETAILED DESCRIPTION OF THE INVENTION

Referring to FIG. 1 to FIG. 4, the present invention discloses a radiator fan fixing buckle device for fixing two radiator fans 30, 30' to the front and rear sides of a cooling device 40. Referring to FIG. 5, the first preferred embodiment comprises a first buckle 10 and a second buckle 20.

Figure 7:
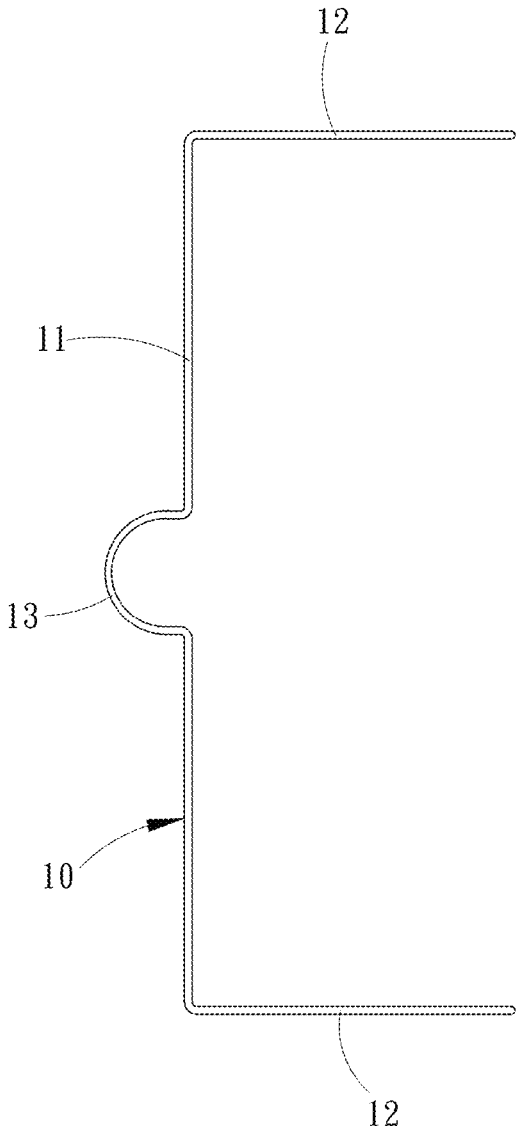
FIG. 7 is a schematic diagram showing that the latching protrusion of the first buckle of the present invention is a U-shaped protrusion or a semicircular protrusion.
Figure 8:
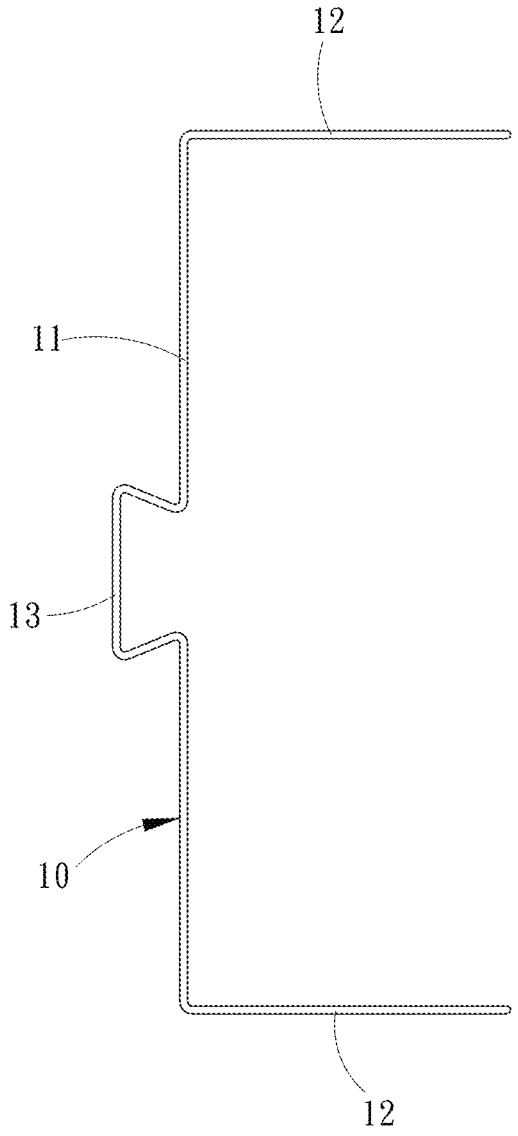
FIG. 8 is a schematic diagram showing the latching protrusion of the first buckle of the present invention as a trapezoidal protrusion.
Figure 9:
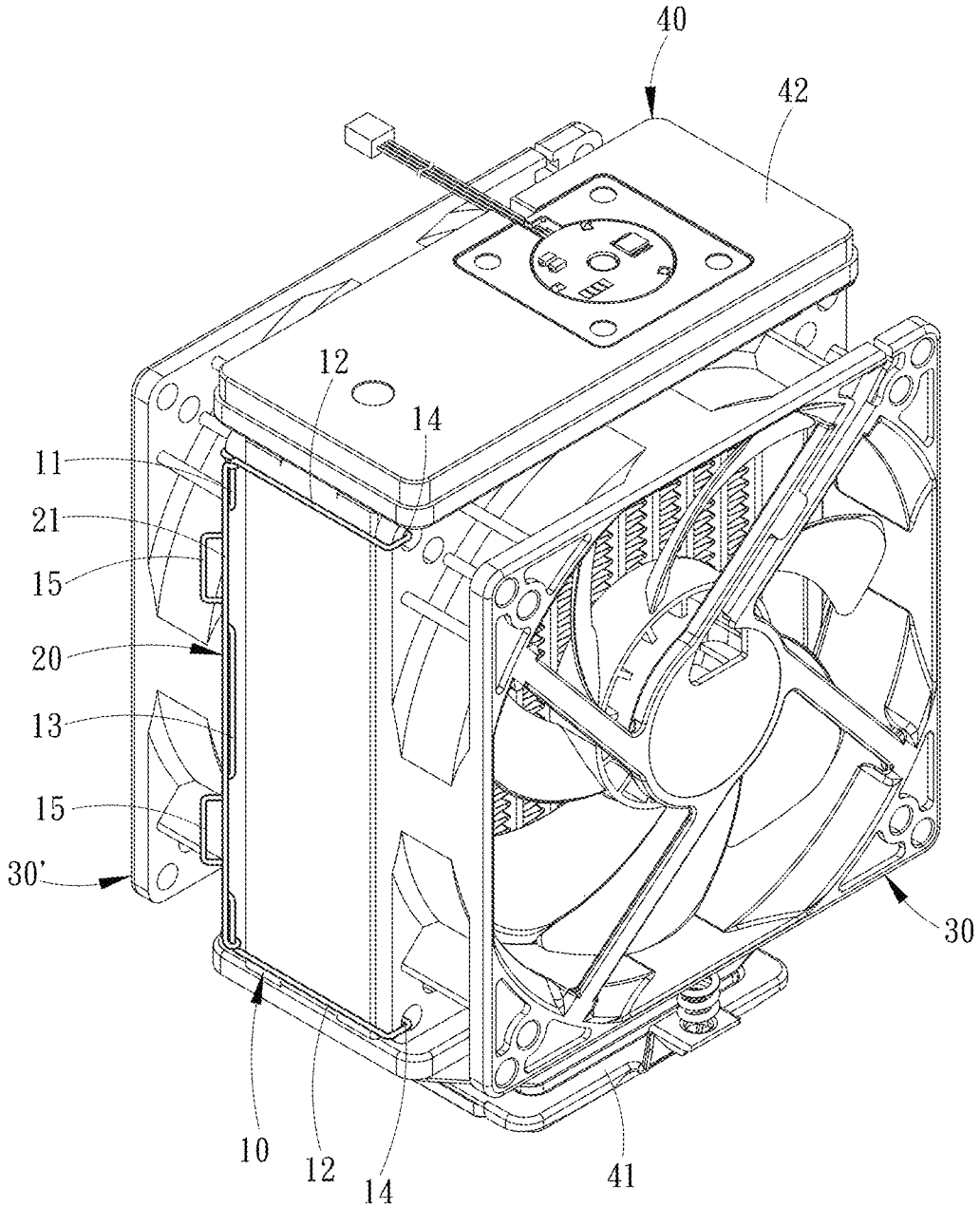
FIG. 9 is a three-dimensional schematic diagram of a second embodiment of the radiator fan fixing buckle device assembly structure of the present invention.

The first buckle 10 is formed by bending a metal strip (such as a stainless-steel strip) into a first vertical strip 11 and two first horizontal strips 12. A latching protrusion 13 is bent at the middle of the first vertical strip 11, and the latching protrusion 13 protrudes in a direction opposite to the free end direction of the first horizontal strips 12. The fixed ends of the two first horizontal strips 12 are integrally connected to the upper and lower ends of the first vertical strip 11. The free ends of the two first horizontal strips 12 are respectively bent to form a first buckling portion 14. The first buckling portion 14 extends toward the first vertical strip 11. The latching protrusion 13 is a square protrusion (as shown in FIG. 5), a U-shaped protrusion, a semicircular protrusion (as shown in FIG. 7), or a trapezoidal protrusion (as shown in FIG. 8) formed by bending the first vertical strip 11, and can be locked on the second buckle 20 (as shown in FIG. 6) when assembled. The first buckling portion 14 is a square body, a U-shaped body, or a semicircular body formed by bending the free end of the respective first horizontal strip 12.

The second buckle 20 is formed by bending a metal strip (such as a stainless-steel strip) into a second vertical strip 21 and two second horizontal strips 22. The second vertical strip 21 is parallel to the first vertical strip 11 during assembly and is used to clamp the latching protrusion 13 of the first buckle 10 (as shown in FIG. 6). The two second horizontal strips 22 are shorter than or equal in length to the first horizontal strips 12 mentioned above. The fixed ends of the two second horizontal strips 22 are respectively bent horizontally in a U-shape to form a hook portion 23. The hook portion 23 is preferably a U-shaped hook. The hook tips of the hook portions 23 of the two second horizontal strips 22 are respectively integrally connected to the upper and lower ends of the second vertical strip 21. The free ends of the two second horizontal strips 22 are bent to form a respective second buckling portion 24, and the second buckling portions 24 extend toward the second vertical strip 21. The second buckling portions 24 are respectively formed by bending the free ends of the second horizontal strip 22 to form a square body, a U-shaped body or a semicircular body.

Figure 1:
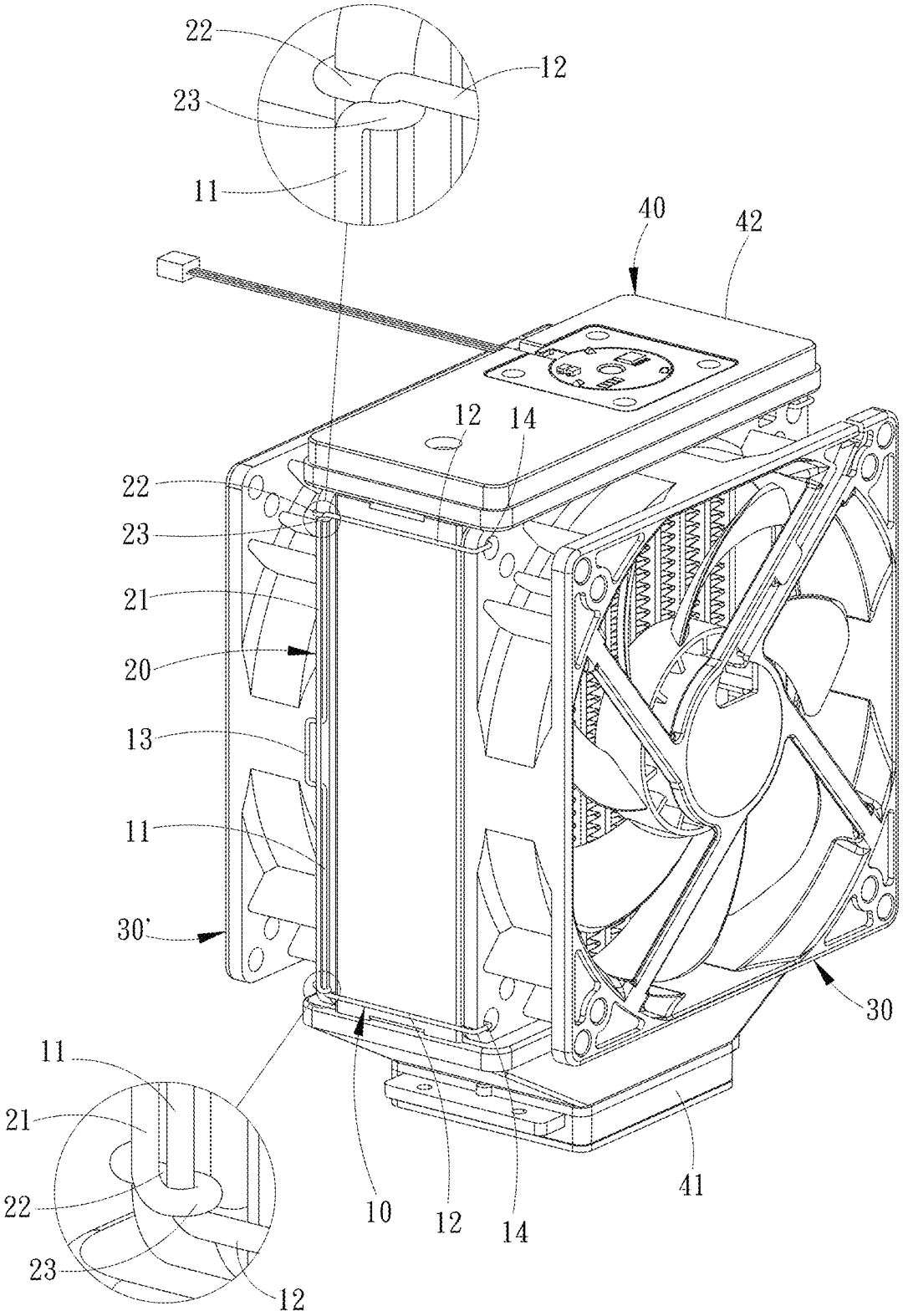
FIG. 1 is a three-dimensional schematic diagram of the first embodiment of the radiator fan fixing buckle device assembly structure of the present invention.
Figure 4:
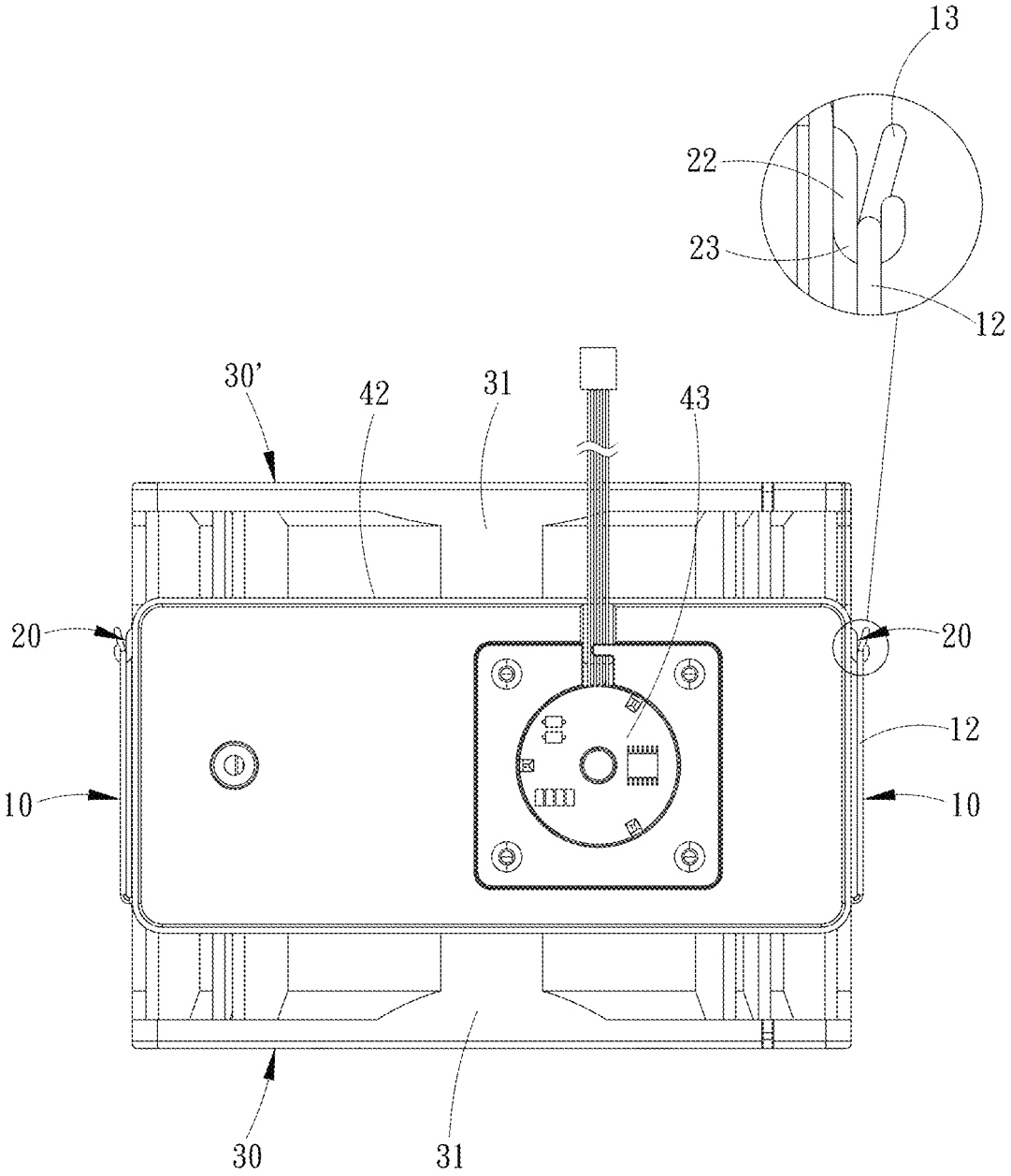
FIG. 4 is a top view schematic diagram of the first embodiment of the radiator fan fixing buckle device assembly structure of the present invention.
Figure 5:
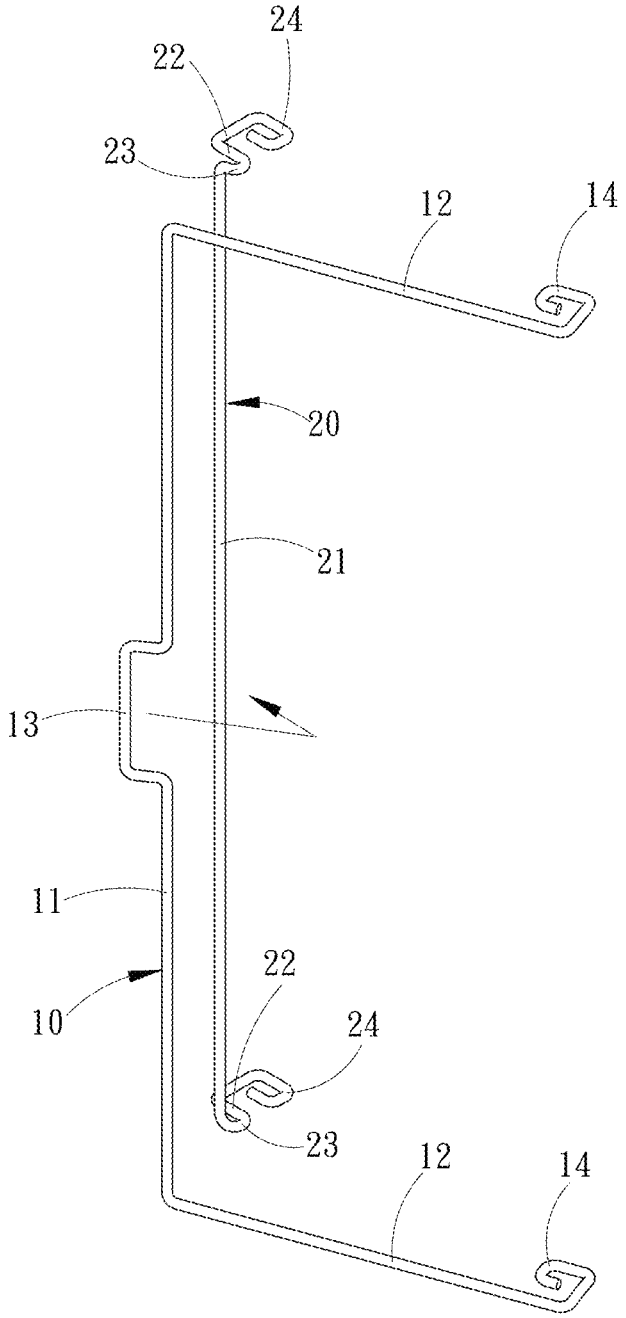
FIG. 5 is a schematic diagram of the first embodiment of the present invention, in which the buckling of the first buckle and the second buckle are in action.
Figure 6:
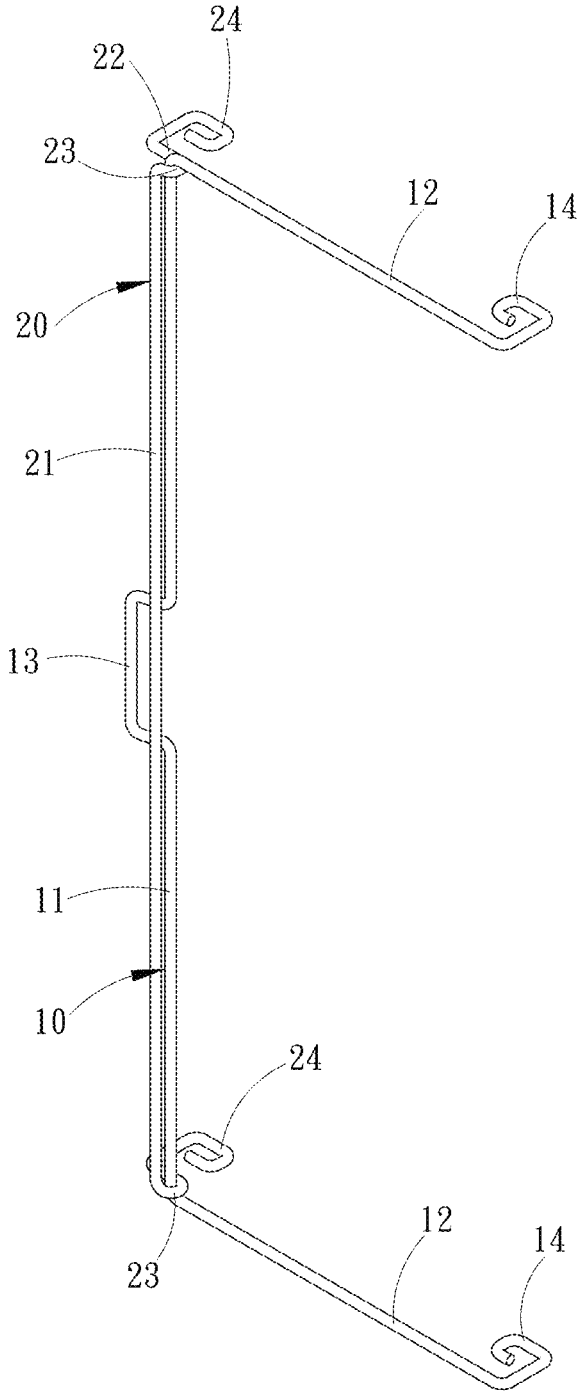
FIG. 6 is a schematic diagram of the first embodiment of the present invention, in which the first buckle and the second buckle are buckled together.

By designing the radiator fan fixing buckle device, as shown in FIG. 1, FIG. 5 and FIG. 6, after the first buckling portions 14 of the first buckle 10 and the second buckling portions 24 of the second buckle 20 are respectively embedded (inserted) into the screw through holes 33 of a radiator fan 30, 30', the first vertical strip 11 of the first buckle 10 can be turned over or adjusted to the outside of the second vertical strip 21 of the second buckle 20, and then force is applied to make the upper and lower parts of the first vertical strip 11 hooked by the hook portions 23 of the second buckle 20 (as shown in FIG. 1, FIG. 4 and FIG. 6). The latching protrusion 13 of the first buckle 10 can also be adjusted by applying pressure from the outside of the second vertical strip 21, so that the latching protrusion 13 is changed to be latched on the inside of the second vertical strip 21 (as shown in FIG. 1 and FIG. 6). Thereby, the first vertical strip 11 of the first buckle 10 cannot be separated from the hook portions 23 without external force, and the latching protrusion 13 of the first buckle 10 cannot be separated from the inner side of the second vertical strip 21 without external force, so that the two radiator fans 30, 30' are fixed to the front and rear surfaces of the radiator 42 of the cooling device 40.

Figure 2:
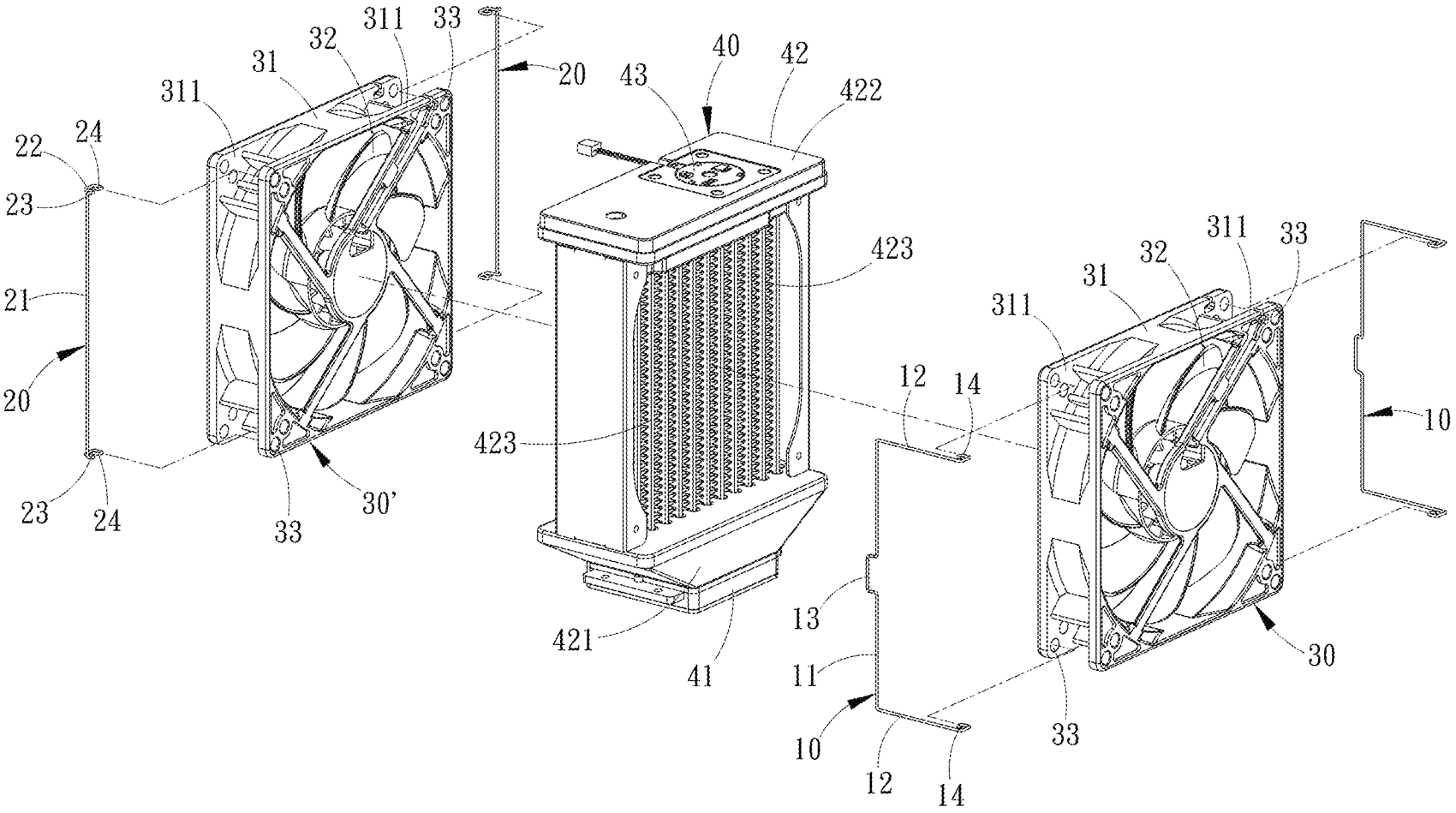
FIG. 2 is a schematic diagram of an exploded view of the first embodiment of the radiator fan fixing buckle device assembly structure of the present invention.
Figure 3:
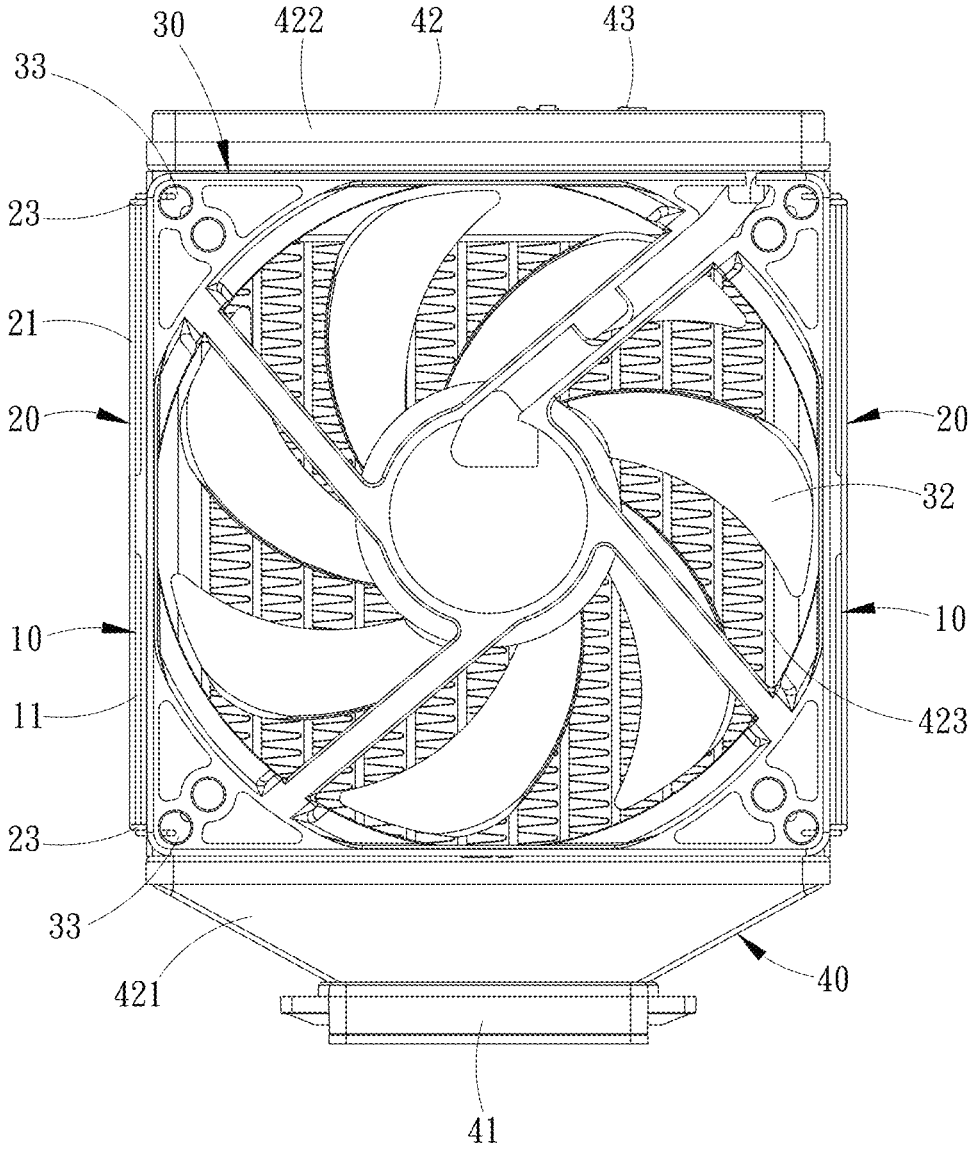
FIG. 3 is a front view schematic diagram of the first embodiment of the radiator fan fixing buckle device assembly structure of the present invention.

Referring to FIG. 1 to FIG. 4 again, based on the features of the first buckle 10 and the second buckle 20, the present invention further proposes a radiator fan fixing buckle device assembly structure, a preferred embodiment of which comprises a cooling device 40, a first radiator fan 30, a second radiator fan 30', two first buckles and two second buckles 20.

The cooling device 40 comprises a cold plate 41 for being attached to a processor, and a radiator 42 fixed to the cold plate 41. The first radiator fan 30 and the second radiator fan 30' are fitted on the front and rear sides of the radiator 42. The first radiator fan 30 and the second radiator fan 30' respectively comprise a housing 31 and an axial flow fan blade 32 disposed in the housing 31, and four corners of the housing 31 are respectively provided with a screw through hole 33. More specifically, the first radiator fan 30 and the second radiator fan 30' are of existing structures, which have two quadrilateral frames 311 located at both ends of the housing 31, and the screw through holes 33 are provided at the four corners of each of the quadrilateral frames 311.

Thus, the two first buckles 10 are disposed on both sides of the first radiator fan 30, and the upper and lower first buckling portions 14 of each first buckle 10 are respectively inserted into the screw through holes 33 of the first radiator fan 30, so that the two first buckles 10 can be located on both sides of the radiator 42. The two second buckles 20 are disposed on both sides of the second radiator fan 30', and the upper and lower second buckling ports 24 of each second buckle 20 are respectively embedded in the screw through holes 33 of the second radiator fan 30'.

By turning or adjusting the first vertical strip 11 of each first buckle 10 by external force applied by the user, the first vertical strip 11 is hooked by the hook portions 23 at the upper and lower sides of the respective second buckle 20, and the latching protrusion 13 of each first buckle 10 is adjusted by force applied to be locked on the inner side of the second vertical strip 21 of the respective second buckle 20. Thereby, the first vertical strips 11 of the first buckles 10 cannot be separated from the respective hook portions 23 without external force, and the latching protrusions 13 of the first buckles 10 cannot be separated from the inner side of the respective second vertical strips 21 without external force.

Referring to FIG. 2, the cooling device 40 of the present invention is preferably implemented as an integrated liquid cooling device, wherein the integrated liquid cooling device comprises a cold plate 41, and the radiator 42 is a liquid cooling radiator. The liquid cooling radiator comprises a first liquid box 421, a second liquid box 422, a plurality of radiator pipes 423 and a liquid pump 43. The interior of the first liquid box 421 is connected to the cold plate 41. The second liquid box 422 is located at a distance relative to the first liquid box 421. The radiator pipes 423 are connected between the first liquid box 421 and the second liquid box 422. The liquid pump 43 is disposed in the second liquid box 422, so that the liquid pump 43 is used to drive the liquid in the liquid cooling radiator to circulate through the cold plate 41 to cool the processor and can bring heat to the radiator pipes 423 to be dissipated by the cold air blown by the two radiator fans 30, 30'.

Figure 10:
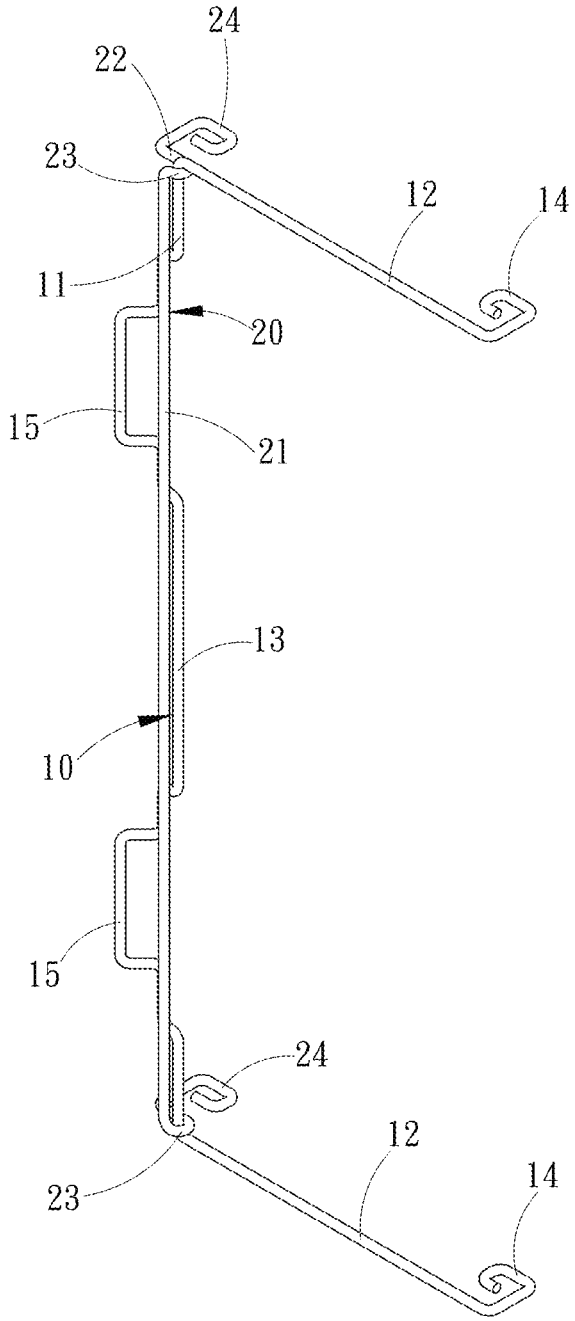
FIG. 10 is a schematic diagram of the buckling state of the first buckle and the second buckle of the second embodiment of the present invention.
Figure 11:
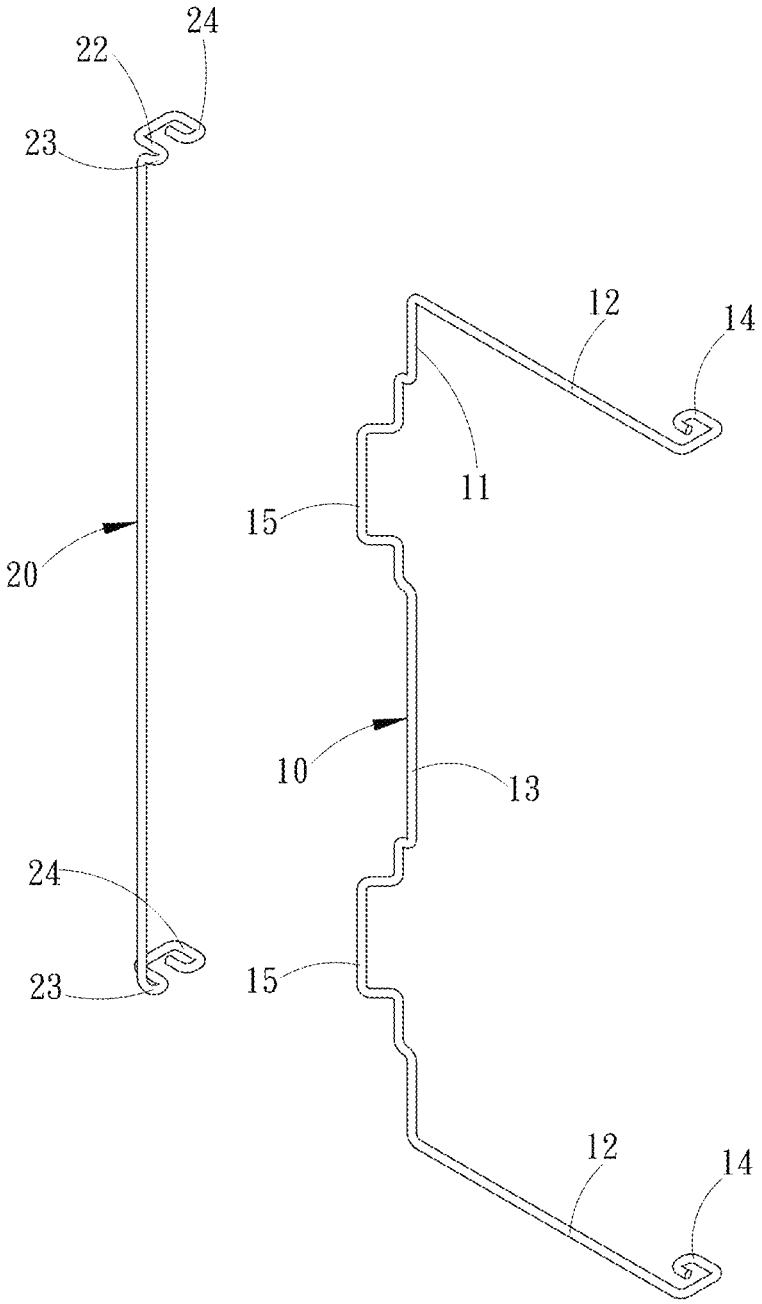
FIG. 11 is a schematic diagram of the exploded state of the second embodiment of the present invention in which the first buckle and the second buckle are interlocked.
Figure 12:
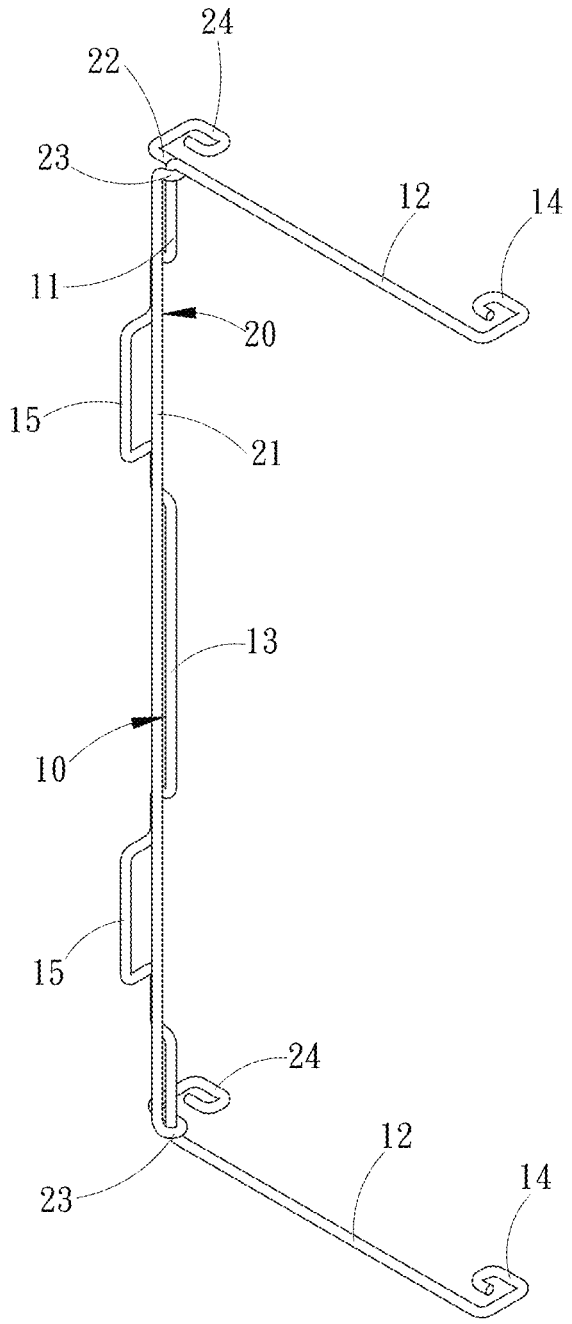
FIG. 12 is a schematic diagram showing the interlocking state of the first buckle and the second buckle according to the second embodiment of the present invention.
Figure 13:
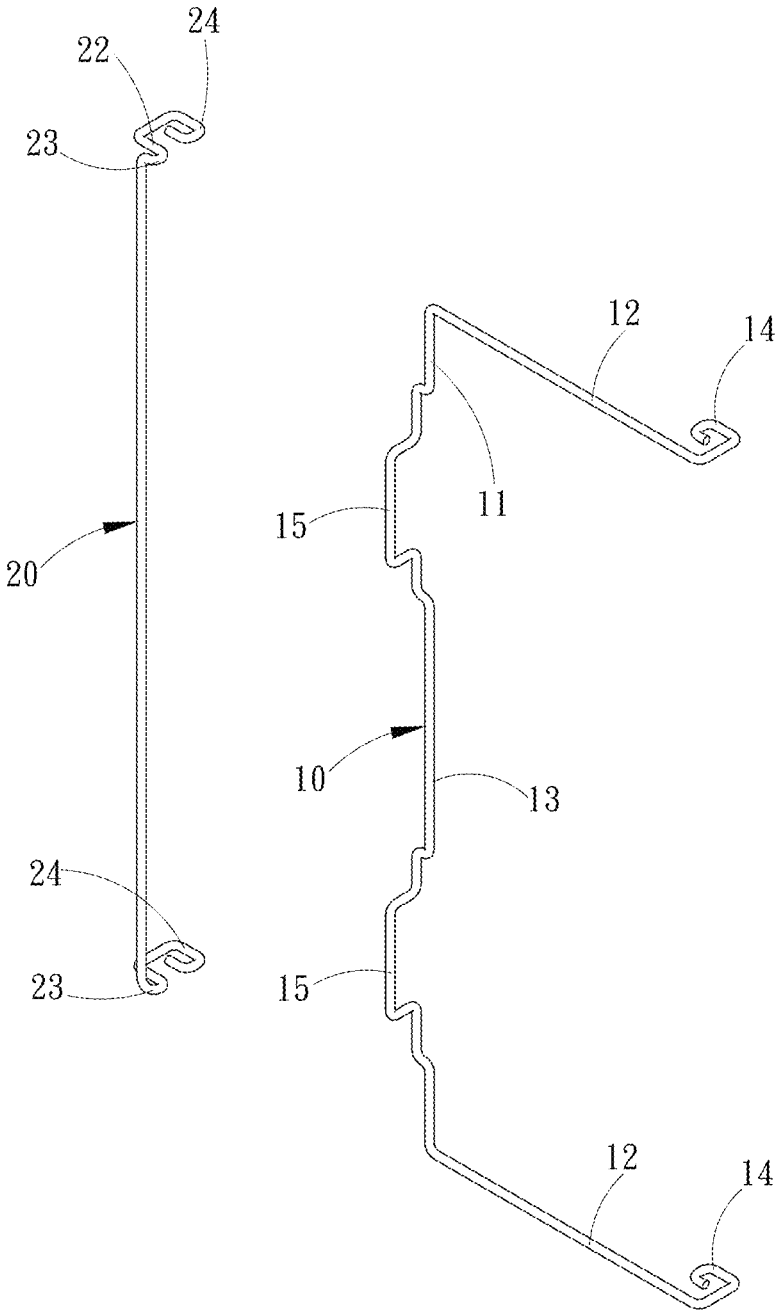
FIG. 13 is a schematic diagram of the exploded state of the second embodiment of the present invention in which the first buckle and the second buckle are interlocked.

Referring to FIG. 9 to FIG. 13, the second preferred embodiment of the present invention also comprises a first buckle 10 and a second buckle 20. The structure of the second preferred embodiment is basically the same as that of the first preferred embodiment, except that: The latching protrusion 13 in the middle of the first vertical strip 11 of the first buckle 10 is changed to protrude toward the free ends of the first horizontal strip 12, and two operating protrusions 15 are respectively bent at the first vertical strip 11 between the latching protrusion 13 and the upper and lower first horizontal strips 12. The operating protrusions 15 are one of square protrusions, U-shaped protrusions, semicircular protrusions or trapezoidal protrusions formed by bending the first vertical strip 11. As shown in FIG. 10 and FIG. 11, the operating protrusions 15 protrude in a direction opposite to the free end direction of the first horizontal strip 12 and protrude at an angle of 45 degrees to the first horizontal strip 12; or as shown in FIG. 12 and FIG. 13, the operating protrusions 15 protrude in a direction opposite to the free end direction of the first horizontal strip 12 and protrude at an angle of 90 degrees to the first horizontal strip 12.

Referring to FIG. 10 and FIG. 12, when the first buckle 10 and the second buckle 20 are assembled, the user can hold the operating protrusions 15 to apply force, so that the hook portions 23 of the second buckle 20 can be hooked on the first vertical strip 11. However, the latching protrusion 13 is opposite to the first preferred embodiment, so that the latching protrusion 13 is reversely latched on the inner side of the second vertical strip 21 of the second buckle 20. At the same time, the operating protrusions 15 extend toward the free ends of the second horizontal strips 22 of the second buckle 20 at an angle of 45 degrees or 90 degrees, so as to facilitate the operation of the first buckle 10 and the second buckle 20 to be engaged or separated.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A radiator fan fixing buckle device, comprising a first buckle and a second buckle, wherein:

said first buckle comprises a first vertical strip and two first horizontal strips formed by bending a metal strip, said first horizontal strips each having a fixed end and an opposing free end, said first vertical strip comprising a latching protrusion bent at the middle thereof, the direction of said protrusion being selectively opposite to or the same as the direction of the free ends of said first horizontal strips, the fixed ends of said two first horizontal strips being respectively connected to opposing upper and lower ends of the said first vertical strip, the free ends of said two first horizontal strips being respectively bent to form a first buckling portion, said first buckling portion extending in the direction of said first vertical strip;

said second comprises a second vertical strip and two second horizontal strips formed by bending a metal strip, said second horizontal strips each having a fixed end and an opposing free end, said second vertical strips being parallel to said first vertical strip, the fixed ends of said two second horizontal strips being respectively bent into a U-shape to form a hook portion, the said hook portions of said two second horizontal strips having a respective hook tip thereof respectively connected to opposing upper and lower ends of said second vertical strip, the free ends of said two second horizontal strips being respectively bent to form a second buckling portion, said second buckling portion extending in the direction of said second vertical strip; and said buckling portions of said two first horizontal strips of said first buckle and said second buckling portions of said two second horizontal strips of said second buckle are respectively used to enable said first vertical strip of said first buckle to be hooked by said hook portions of said second buckle, and said latching protrusion of said first buckle to be latched on an inner side of said second vertical strip after being respectively embedded in a radiator fan.

2. The radiator fan fixing buckle device as claimed in claim 1, wherein said first buckle further comprises two operating protrusions respectively bent at said first vertical strip between said latching protrusion and said two first horizontal strips, said operating protrusions protruding in a direction opposite to the direction of the free ends of said first horizontal strips, said operating protrusions and said first horizontal strips protruding at an angle of 30 degrees to 90 degrees to each other.

3. The radiator fan fixing buckle device as claimed in claim 1, wherein said latching protrusion is selectively a square protrusion, U-shaped protrusion, semicircular protrusion or trapezoidal protrusion formed by bending said first vertical strip.

4. The radiator fan fixing buckle device as claimed in claim 3, wherein said first buckling portion of each said first horizontal strip is selectively a square body, a U-shaped body, or a semicircular body formed by bending the free end of the respective said first horizontal strip.

5. The radiator fan fixing buckle device as claimed in claim 1, wherein said second buckling portion of each said second horizontal strip is selectively a square body, a U-shaped body, or a semicircular body formed by bending the free end of the respective said second horizontal strip.

6. The radiator fan fixing buckle device as claimed in claim 2, wherein said operating protrusions are selectively square protrusions, U-shaped protrusions, semicircular protrusions or trapezoidal protrusions formed by bending said first vertical strip.

7. The radiator fan fixing buckle device as claimed in claim 1, wherein said metal strips are round stainless-steel strips.

8. A radiator fan fixing buckle device assembly structure, comprising a cooling device, a first radiator fan, a second radiator fan, and two first buckles and two second buckles as claimed in claim 1, wherein:

said cooling device comprises a cold plate and a radiator fixed on said cold plate;

said first radiator fan and said second radiator fan are placed on opposing front and rear sides of said radiator, said first radiator fan and said second radiator fan each comprising a housing, and an axial flow fan blade disposed in said housing, said housing having each of four corners of each of front and rear sides thereof respectively provided with a screw through hole;

said two first buckles are arranged on two opposite lateral sides of said first radiator fan, said first buckling portions of said first buckles being respectively inserted into the said screw through holes of said first radiator fan, so that said two first buckles are located on the two opposite lateral sides of said first radiator;

said two second buckles are arranged on two opposite lateral sides of said second radiator fan, said second buckling portions of said second buckles being respectively inserted into the said screw through holes of said second radiator fan; and said first vertical strip of each said first buckle is hooked by said hook portions of each said second buckle, and the latching protrusion of each said first buckle is latched on an inner side of said second vertical strip of the respective said second buckle.

9. The radiator fan fixing buckle device assembly structure as claimed in claim 8, wherein said housing comprises two quadrilateral frames located at two opposite sides thereof, said quadrilateral frames each having four corners thereof provided with said screw through holes; said first buckling portions and said second buckling portions are respectively embedded in the said screw through holes of said quadrilateral frames adjacent to said radiator.

10. The radiator fan fixing buckle device assembly structure as claimed in claim 8, wherein said cooling device is an integrated liquid cooling device and said radiator is a liquid cooling radiator, said liquid cooling radiator comprising a first liquid box, a second liquid box, a plurality of radiator pipes and a liquid pump, said first liquid box having the interior thereof connected to said cold plate, said second liquid box being located at a distance relative to said first liquid box, said radiator pipes being connected between said first liquid box and said second liquid box, said liquid pump being set in said second liquid box, said liquid pump being used to circulate a liquid in said liquid cooling radiator through said cold plate.

* * * * *